US007807231B2

(12) United States Patent
Gorman et al.

(10) Patent No.: US 7,807,231 B2
(45) Date of Patent: Oct. 5, 2010

(54) PROCESS FOR FORMING THERMAL BARRIER COATING RESISTANT TO INFILTRATION

(75) Inventors: Mark Daniel Gorman, West Chester, OH (US); Bangalore Aswatha Nagaraj, West Chester, OH (US); Robert Edward Schafrik, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 1149 days.

(21) Appl. No.: 11/164,615

(22) Filed: Nov. 30, 2005

(65) Prior Publication Data

US 2008/0113095 A1 May 15, 2008

(51) Int. Cl.

| | |
|---|---|
| ***H05H 1/24*** | (2006.01) |
| ***B05D 3/06*** | (2006.01) |
| ***B05D 5/00*** | (2006.01) |
| ***B05D 3/04*** | (2006.01) |
| ***B05D 3/02*** | (2006.01) |
| ***B05D 3/14*** | (2006.01) |

(52) U.S. Cl. ..... 427/535; 427/532; 427/539; 427/576; 427/376.2; 427/376.3; 427/376.4; 427/377; 427/383.3; 427/383.7; 427/419.3

(58) Field of Classification Search ..... None
See application file for complete search history.

(56) References Cited

U.S. PATENT DOCUMENTS 5,447,291 A * 9/1995 Sandhage ..... 148/516
5,616,229 A * 4/1997 Samsonov et al. ..... 205/107
5,624,721 A * 4/1997 Strangman ..... 427/585
5,660,885 A 8/1997 Hasz et al.
5,871,820 A * 2/1999 Hasz et al. ..... 427/419.2

(Continued)

FOREIGN PATENT DOCUMENTS

EP 1587348 10/2005

(Continued)

OTHER PUBLICATIONS

RC Weast, Ph.D., editor, CRC Handbook of Chemistry and Physics, 56th edition, CRC press, Cleveland, Ohio, excerpt pp. B-82, B-83, B-68, B-109, B-137, 1975.*

(Continued)

*Primary Examiner*—Marianne L Padgett
(74) *Attorney, Agent, or Firm*—William Scott Andes; Gary M. Hartman; Domenica N. S. Hartman

(57) ABSTRACT

A process for protecting a thermal barrier coating (TBC) on a component used in a high-temperature environment, such as the hot section of a gas turbine engine. The process applies a protective film on the surface of the TBC to resist infiltration of contaminants such as CMAS that can melt and infiltrate the TBC to cause spallation. The process generally entails applying to the TBC surface a metal composition containing at least one metal whose oxide resists infiltration of CMAS into the TBC. The metal composition is applied so as to form a metal film on the TBC surface and optionally to infiltrate porosity within the TBC beneath its surface. The metal composition is then converted to form an oxide film, with at least a portion of the oxide film forming a surface deposit on the TBC surface.

19 Claims, 1 Drawing Sheet

U.S. PATENT DOCUMENTS

| | | | | |
|---|---|---|---|---|
| 6,103,386 | A * | 8/2000 | Raybould et al. | 428/472 |
| 6,365,028 | B1 * | 4/2002 | Shatrov | 205/102 |
| 6,395,343 | B1 * | 5/2002 | Strangman | 427/454 |
| 6,465,090 | B1 | 10/2002 | Stowell et al. | 428/325 |
| 6,627,323 | B2 | 9/2003 | Nagaraj et al. | 428/469 |
| 6,635,124 | B1 * | 10/2003 | Stowell et al. | 148/277 |
| 6,709,767 | B2 * | 3/2004 | Lin et al. | 428/814 |
| 6,720,038 | B2 | 4/2004 | Darolia et al. | 427/596 |
| 6,756,082 | B1 | 6/2004 | Subramanian et al. | |
| 6,881,439 | B2 * | 4/2005 | Graham et al. | 427/142 |
| 6,890,668 | B2 | 5/2005 | Bruce et al. | 428/632 |
| 2003/0152797 | A1 * | 8/2003 | Darolia et al. | 428/633 |
| 2004/0013924 | A1 * | 1/2004 | Park et al. | 429/33 |
| 2004/0109948 | A1 * | 6/2004 | Graham et al. | 427/383.1 |
| 2004/0115406 | A1 * | 6/2004 | Nagaraj et al. | 428/209 |
| 2004/0115410 | A1 * | 6/2004 | Nagaraj et al. | 428/210 |
| 2004/0115470 | A1 * | 6/2004 | Ackerman et al. | 428/660 |
| 2004/0115471 | A1 * | 6/2004 | Nagaraj et al. | 428/660 |
| 2004/0170849 | A1 | 9/2004 | Ackerman et al. | |
| 2004/0214025 | A1 * | 10/2004 | Ackerman et al. | 428/469 |
| 2005/0158590 | A1 * | 7/2005 | Li | 428/698 |
| 2006/0139144 | A1 * | 6/2006 | LaBarge et al. | 338/308 |

FOREIGN PATENT DOCUMENTS

| | | |
|---|---|---|
| WO | WO2005095665 | 10/2005 |

OTHER PUBLICATIONS

Wang et al. "Diffusion of the hydrous component in pyrope", American Mineralogist, vol. 81, pp. 706-718, 1996.*

Berman et al., "Heat capacity of minerals in the system Na20-K2O-CaO-MgO-FeO-Fe2O3-Al2O3-SiO2-TiO2-H2O-CO2: representation, estimation, and high temperature extrapolation", Contributions to Mineralology and Petrology, vol. 89, pp. 168-183, 1985.*

* cited by examiner

PROCESS FOR FORMING THERMAL BARRIER COATING RESISTANT TO INFILTRATION

BACKGROUND OF THE INVENTION

This invention generally relates to coatings for components exposed to high temperatures, such as the hostile thermal environment of a gas turbine engine. More particularly, this invention is directed to a process for forming a protective coating on a thermal barrier coating on a gas turbine engine component, in which the protective coating is resistant to infiltration by contaminants present in the operating environment of a gas turbine engine.

Hot section components of gas turbine engines are often protected by a thermal barrier coating (TBC), which reduces the temperature of the underlying component substrate and thereby prolongs the service life of the component. Ceramic materials and particularly yttria-stabilized zirconia (YSZ) are widely used as TBC materials because of their high temperature capability, low thermal conductivity, and relative ease of deposition by plasma spraying, flame spraying and physical vapor deposition (PVD) techniques. Plasma spraying processes such as air plasma spraying (APS) yield noncolumnar coatings characterized by a degree of inhomogeneity and porosity, and have the advantages of relatively low equipment costs and ease of application. TBC's employed in the highest temperature regions of gas turbine engines are often deposited by PVD, particularly electron-beam PVD (EBPVD), which yields a strain-tolerant columnar grain structure. Similar columnar microstructures with a degree of porosity can be produced using other atomic and molecular vapor processes.

To be effective, a TBC must strongly adhere to the component and remain adherent throughout many heating and cooling cycles. The latter requirement is particularly demanding due to the different coefficients of thermal expansion (CTE) between ceramic materials and the substrates they protect, which are typically superalloys, though ceramic matrix composite (CMC) materials are also used. An oxidation-resistant bond coat is often employed to promote adhesion and extend the service life of a TBC, as well as protect the underlying substrate from damage by oxidation and hot corrosion attack. Bond coats used on superalloy substrates are typically in the form of an overlay coating such as MCrAlX (where M is iron, cobalt and/or nickel, and X is yttrium or another rare earth element), or a diffusion aluminide coating. During the deposition of the ceramic TBC and subsequent exposures to high temperatures, such as during engine operation, these bond coats form a tightly adherent alumina ($Al_2O_3$) layer or scale that adheres the TBC to the bond coat.

The service life of a TBC system is typically limited by a spallation event driven by bond coat oxidation, increased interfacial stresses, and the resulting thermal fatigue. In addition to the CTE mismatch between a ceramic TBC and a metallic substrate, spallation can be promoted as a result of the TBC being contaminated with compounds found within a gas turbine engine during its operation. Notable contaminants include such oxides as calcia, magnesia, alumina and silica, which when present together at elevated temperatures form a compound referred to herein as CMAS. CMAS has a relatively low melting temperature of about 1225° C. (and possibly lower, depending on its exact composition), such that during engine operation the CMAS can melt and infiltrate the porosity within cooler subsurface regions of the TBC, where it resolidifies. As a result, during thermal cycling TBC spallation is likely to occur from the infiltrated solid CMAS interfering with the strain-tolerant nature of columnar TBC and the CTE mismatch between CMAS and the TBC material, particularly TBC deposited by PVD and APS due to the ability of the molten CMAS to penetrate their columnar and porous grain structures, respectively. Another detriment of CMAS is that the bond coat and substrate underlying the TBC are susceptible to corrosion attack by alkali deposits associated with the infiltration of CMAS.

Various studies have been performed to find coating materials that are resistant to infiltration by CMAS. Notable examples are commonly-assigned U.S. Pat. Nos. 5,660,885, 5,773,141, 5,871,820 and 5,914,189 to Hasz et al., which disclose three types of coatings to protect a TBC from CMAS-related damage. These protective coatings are generally described as being impermeable, sacrificial, or non-wetting to CMAS. Impermeable coatings are defined as inhibiting infiltration of molten CMAS, and include silica, tantala, scandia, alumina, hafnia, zirconia, calcium zirconate, spinels, carbides, nitrides, silicides, and noble metals such as platinum. Sacrificial coatings are said to react with CMAS to increase the melting temperature or the viscosity of CMAS, thereby inhibiting infiltration. Suitable sacrificial coating materials include silica, scandia, alumina, calcium zirconate, spinels, magnesia, calcia, and chromia. As its name implies, a non-wetting coating reduces the attraction between the solid TBC and the liquid (e.g., molten CMAS) in contact with it. Suitable non-wetting materials include silica, hafnia, zirconia, beryllium oxide, lanthana, carbides, nitrides, silicides, and noble metals such as platinum. According to the Hasz et al. patents, an impermeable coating or a sacrificial coating can be deposited directly on the TBC, and may be followed by a layer of an impermeable coating (if a sacrificial coating was deposited first), a sacrificial coating (if the impermeable coating was deposited first), or a non-wetting coating. If used, the non-wetting coating is the outermost coating of the protective coating system.

Other coating systems resistant to CMAS have been proposed, including those disclosed in commonly-assigned U.S. Pat. Nos. 6,465,090, 6,627,323, and 6,720,038. With each of these, alumina is a noted candidate as being an effective sacrificial additive or coating, in other words, reducing the impact of CMAS infiltration by reacting with CMAS (being sacrificially consumed) to raise the melting point and viscosity of CMAS. A number of approaches have been considered for applying alumina and other materials capable of inhibiting CMAS infiltration (hereinafter, CMAS inhibitors), including those disclosed by the above-identified commonly-assigned patents. Certain approaches are more effective at placing a CMAS inhibitor into the open porosity within the TBC, while others such as EB-PVD deposition, slurry top coats, and laser glazing tend to be more effective at depositing the CMAS inhibitor as a discrete outer layer on the TBC. In the case of alumina, the approach has generally been to provide alumina in the form of an additive layer overlying the TBC, rather than as a co-deposited additive within the TBC, since solid alumina and zirconia are essentially immiscible and the mechanism by which alumina provides CMAS protection is through sacrificial consumption. Nonetheless, it is desirable to have at least some alumina deposited in the open porosity of a TBC to maintain a level of CMAS protection in the event the alumina layer is breached or lost through spallation, erosion, and/or consumption.

Chemical vapor deposition (CVD) processes have been shown to be capable of being optimized for either higher deposition rates that primarily deposit alumina as a discrete additive layer on the outer TBC surface, or lower deposition rates that promote infiltration of a relatively small amount of alumina into the open porosity of a TBC. Spallation tests with CMAS contamination have indicated that TBC's protected with either approach exhibit similar CMAS resistance, even though those primarily infiltrated with alumina have much lower alumina contents. However, the CVD deposition of alumina with good penetration into the porosity of a TBC generally requires expensive specialized equipment and is typically limited to very low deposition rates.

Another approach capable of infiltrating a TBC with a CMAS inhibitor is liquid infiltration with a precursor of the inhibitor. To be successful, the precursor and any solvents, carriers, etc., used therewith must not damage the TBC, other layers of the TBC system, or the substrate protected by the TBC system. Other key requirements for a successful liquid infiltration approach include achieving an adequate degree of infiltration and depositing an effective quantity of alumina. To promote the latter, the precursor should contain a relatively high level of aluminum that can be converted to yield a known or predictable amount of alumina. For those precursors requiring a solvent or carrier, another important consideration is the solubility of the precursor in its carrier since a precursor with a high conversion efficiency will not be effective if only a small loading of the precursor can be placed into solution.

In view of the above, while various approaches are known for depositing alumina and other CMAS inhibitors, there is an ongoing need for deposition techniques capable of depositing an effective amount of a CMAS inhibitor on and/or within a TBC that will optimize the ability of the inhibitor to prevent damage from CMAS infiltration.

BRIEF SUMMARY OF THE INVENTION

The present invention generally provides a process for protecting a thermal barrier coating (TBC) on a component used in a high-temperature environment, such as the hot section of a gas turbine engine. The invention is particularly directed to a process by which a CMAS inhibitor is applied so as to form a protective deposit on the surface of the TBC that resists infiltration of CMAS into the TBC, such as by reacting with CMAS to raise its melting point and/or viscosity.

The process of this invention generally entails applying to a surface of the TBC a metal composition containing at least one metal whose oxide resists infiltration of CMAS into the TBC. The metal composition is applied so as to form a metal film on the TBC surface and optionally to infiltrate porosity within the TBC beneath its surface. The metal composition is then converted to form an oxide film of the oxide of the at least one metal. At least a portion of the oxide film forms a surface deposit on the TBC surface.

In view of the above, the process of this invention produces a protective deposit capable of increasing the temperature capability of a TBC by reducing the vulnerability of the TBC to spallation and the underlying substrate to corrosion from CMAS contamination. Depending on the type of metal composition used and the process by which the metal composition is applied and optionally treated after its application, the protective deposit can be formed so as to not only cover the surface of the TBC, but also extend protection into subsurface regions of the TBC where resistance to CMAS is also important for long-term resistance to CMAS contamination.

Other objects and advantages of this invention will be better appreciated from the following detailed description.

DETAILED DESCRIPTION OF THE INVENTION

Figure 1:
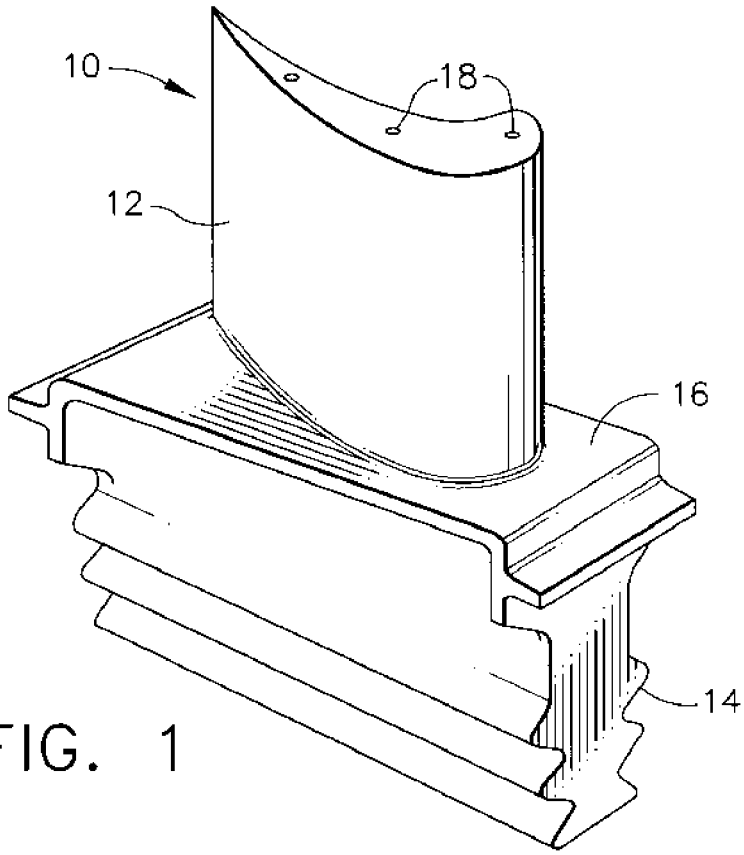
FIG. 1 is a perspective view of a high pressure turbine blade.

The present invention will be described in reference to a high pressure turbine blade 10 shown in FIG. 1, though the invention is applicable to a variety of components that operate within a thermally and chemically hostile environment. The blade 10 generally includes an airfoil 12 against which hot combustion gases are directed during operation of the gas turbine engine, and whose surfaces are therefore subjected to severe attack by oxidation, hot corrosion and erosion as well as contamination by CMAS. The airfoil 12 is anchored to a turbine disk (not shown) with a dovetail 14 formed on a root section 16 of the blade 10. Cooling holes 18 are present in the airfoil 12 through which bleed air is forced to transfer heat from the blade 10.

Figure 2:
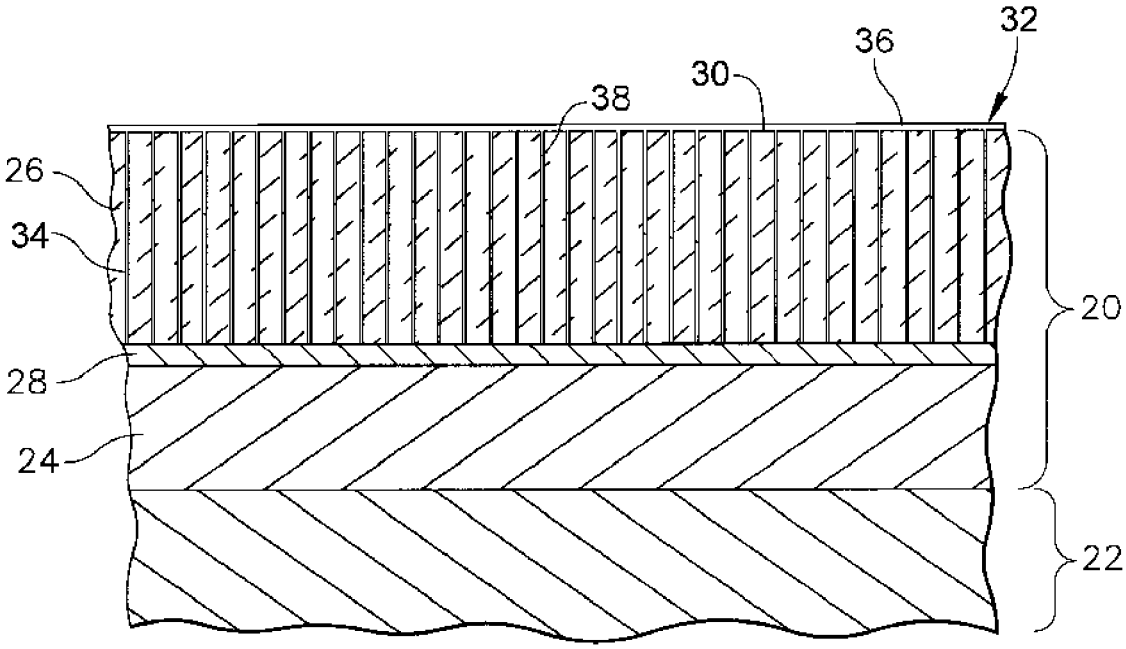
FIG. 2 is a cross-sectional view of a surface region of the blade of FIG. 1, and shows a protective deposit on a TBC in accordance with an embodiment of this invention.

The surface of the airfoil 12 is protected by a TBC system 20, represented in FIG. 2 as including a metallic bond coat 24 that overlies the surface of a substrate 22, the latter of which is typically the base material of the blade 10 and preferably formed of a superalloy, such as a nickel, cobalt, or iron-base superalloy. As widely practiced with TBC systems for components of gas turbine engines, the bond coat 24 is preferably an aluminum-rich composition, such as an overlay coating of an MCrAlX alloy or a diffusion coating such as a diffusion aluminide or a diffusion platinum aluminide, all of which are well-known in the art. Aluminum-rich bond coats develop an aluminum oxide (alumina) scale 28, which grows as a result of oxidation of the bond coat 24. The alumina scale 28 chemically bonds a TBC 26, formed of a thermal-insulating material, to the bond coat 24 and substrate 22. The TBC 26 of FIG. 2 is represented as having a strain-tolerant microstructure of columnar grains. As known in the art, such columnar microstructures can be achieved by depositing the TBC 26 using a physical vapor deposition (PVD) technique, such as EBPVD. The invention is also applicable to noncolumnar TBC deposited by such methods as plasma spraying, including air plasma spraying (APS). A TBC of this type is in the form of molten "splats," resulting in a microstructure characterized by irregular flattened (and therefore noncolumnar) grains and a degree of inhomogeneity and porosity.

As with prior art TBC's, the TBC 26 of this invention is intended to be deposited to a thickness that is sufficient to provide the required thermal protection for the underlying substrate 22 and blade 10. A suitable thickness is generally on the order of about 75 to about 300 micrometers. A preferred material for the TBC 26 is an yttria-stabilized zirconia (YSZ), a preferred composition being about 3 to about 8 weight percent yttria (3-8% YSZ), though other ceramic materials could be used, such as nonstabilized zirconia, or zirconia partially or fully stabilized by magnesia, ceria, scandia or other oxides.

Of particular interest to the present invention is the susceptibility of TBC materials, including YSZ, to attack by CMAS. As discussed previously, CMAS is a relatively low melting compound that when molten is able to infiltrate columnar and noncolumnar TBC's, and subsequently resolidify to promote spallation during thermal cycling. To address this concern, the TBC 26 in FIG. 2 is shown as being provided with a protective film 32 of this invention. As a result of being present on the outermost surface of the blade 10, the protective film 32 serves as a barrier to CMAS infiltration of the underlying TBC 26. The protective film 32 is shown in FIG. 2 as comprising a surface deposit 36 that overlies the surface 30 of the TBC 26 so as to be available for sacrificial reaction with CMAS, and further comprises an infiltrated internal deposit 38 that extends into porosity 34 within the TBC 26 and provides a level of CMAS protection in the event the surface deposit 36 is breached or lost through spallation, erosion, and/or consumption. In the case of the columnar TBC 26 schematically represented in FIG. 2, porosity 34 is represented in part as being defined by gaps between individual columns of the TBC 26. However, additional porosity is also likely to be present within the columns, for example, in the surfaces of individual columns if the TBC 26 were deposited by EB-PVD to have a feather-like grain structure as known in the art.

As represented in FIG. 2, the surface deposit 36 of the protective film 32 forms a continuous layer on the outer surface 30 of the TBC 26, though it is within the scope of this invention that a discontinuous layer could be deposited. The degree to which the internal deposit 38 of the protective film 32 occupies the porosity 34 between and within the TBC grains will depend in part on the particular composition used to form the protective film 32, as discussed in greater detail below, and particularly on the structure of the TBC 26, with more open porosity receiving (and needing) greater amounts of the internal deposit 38. On a volume basis, the protective film 32 is believed to be predominantly present as the surface deposit 36 on the TBC surface 30.

According to a preferred aspect of the invention, the protective film 32 contains at least one metal oxide that resists infiltration of CMAS into the TBC 26, such as by reacting with CMAS to raise its melting point and/or viscosity. Preferred oxides are alumina ($Al_2O_3$) and magnesia (MgO), with a preferred protective film 32 being predominantly or more preferably entirely one or more of these oxides. However, it is foreseeable that other metal oxides could be used, such as those disclosed in the above-noted patents to Hasz et al., whose contents relating to such sacrificial coating materials are incorporated herein by reference. The metal oxide content of the protective film 32 is sacrificially consumed by reacting with molten CMAS that deposits on the film 32 and possibly infiltrates the porosity 34 of the TBC 26, and in doing so forms one or more refractory phases with higher melting temperatures than CMAS. In the case of alumina and magnesia, reaction with molten CMAS causes the levels of these oxides in the CMAS to be increased, yielding a modified CMAS with a higher melting temperature and/or greater viscosity that inhibits infiltration of the molten CMAS into the TBC 26. As a result, the reaction product or products of CMAS and the one or more metal oxides of the protective film 32 more slowly infiltrate the TBC 26 and tend to resolidify before sufficient infiltration has occurred to cause spallation.

According to the invention, the protective film 32 is formed by applying to the TBC surface 30 a metal film containing the one or more metals of the desired metal oxide or oxides, and then oxidizing the metal film to form the desired metal oxide (s). If infiltration of the TBC porosity 34 is desired, the metal film can be deposited so as to infiltrate the TBC 26 during deposition. For example, the TBC 26 can be sufficiently heated during deposition of the metal film to melt the film and cause simultaneous infiltration of the TBC 26 by the molten metal composition. Alternatively, the TBC 26 can be heated after deposition of the metal film to melt the film and cause infiltration of the TBC 26. In addition to achieving infiltration of the TBC 26, melting of the metal film is desirable for improving the thickness uniformity and surface finish of the surface deposit 36. With melting points of about 660° C. and about 650° C., respectively, commercially pure (99 wt. % or more) aluminum and magnesium are well suited for infiltration of the TBC 26. Infiltration of the TBC 26 can be promoted by suitably alloying the metal(s) of the desired metal oxide(s). For example, aluminum can be alloyed with magnesium and/or silicon to modify the fluidity of the molten film during infiltration, as well as modify the CMAS mitigation behavior of the protective film 32. As a particular example, an aluminum alloy containing about 12 weight percent silicon has a melting point of about 575° C. and greater fluidity than molten pure aluminum, and as a result promotes penetration of the TBC porosity 34 and a smoother surface finish for the surface deposit 36, the latter of which is beneficial for aerodynamic performance of the component 10.

Application of the metal film on the TBC 26 can be by a variety of processes that do not cause excessive oxidation of the metal being deposited. A particularly suitable process is ion plasma deposition (IPD) in an atmosphere containing a low partial pressure of oxygen, such as an inert atmosphere. Other potential deposition techniques include other PVD processes such as EBPVD and sputtering, thermal spray processes such as low pressure plasma spraying (LPPS), laser-assisted processes such as pulsed laser deposition (PVD), and painting an aluminum paint. Limited oxidation (e.g., possibly up to 50% by volume) during deposition is believed to be acceptable, and may be advantageous by inhibiting running or coalescence of the metallic deposit during coating and subsequent high temperature treatments. Suitable thicknesses for the metal film are believed to be as little as about two micrometers up to about fifteen micrometers, with film thicknesses of up to fifty micrometers or more also being within the scope of this invention. Metal film thicknesses of about two to fifteen micrometers generally yield a surface deposit 36 having a thickness of about three to about twenty micrometers, which is sufficient to provide a desirable level of resistance to CMAS infiltration. Metal film thicknesses of fifteen micrometers or more (yielding a surface deposit 36 having a thickness of about twenty micrometers or more) provide the additional benefit of promoting the erosion and impact resistance of the surface deposit 36 and the underlying TBC 26. However, with increasing thickness, the metal film is more likely to run or coalesce during thermal treatments, is more difficult to completely oxidize to form the deposit 32, and the resulting thicker deposit 32 is less resistant to spallation due to thermal expansion mismatch.

After deposition and, if desired, melting of the metal film to promote TBC infiltration, thickness uniformity, and/or surface finish, the metal composition of the film undergoes in-situ oxidation on the surface 30 of the TBC 26 to form the protective film 32 containing the desired oxide(s). For this purpose, the metal film can be heated in an oxidizing (high $PO_2$) atmosphere, such as air. Alternatively, the metal film can be converted to form the protective film 32 by electrochemically reacting the metal composition of the metal film in an electrolytic treatment, such as of the type performed by anodizing, in which the metal composition serves as an anode. Oxidation in air has the advantage of convenience and a simple process that does not require chemicals, while electrochemical oxidation has the advantages of a low processing temperature and a high surface area coating. In either case, the oxidation step is preferably carried out to convert substantially all metal constituents of the metal film to their oxides. The time and temperature of the oxidation process can also be selected to take into consideration aging of the superalloy substrate 22, morphology of the surface deposit 36, adhesion of the surface deposit 36 to the internal deposit 38 and the TBC 26, etc.

There are various opportunities for depositing the protective film 32 of this invention. For example, the film 32 can be applied to newly manufactured components that have not been exposed to service. Alternatively, the film 32 can be applied to a component that has seen service and whose TBC must be cleaned and rejuvenated before return to the field. In the latter case, applying the film 32 to the TBC can significantly extend the life of the component beyond that otherwise possible if the TBC was not protected by the film 32. In addition, the film 32 may be deposited on only those surfaces of a component that are particularly susceptible to damage from CMAS infiltration. In the case of the blade 10 shown in FIG. 1, of particular interest is often the concave (pressure) surface of the airfoil 12, which is significantly more susceptible to attack than the convex (suction) surface as a result of aerodynamic considerations. The blade 10 can be masked to selectively form the protective film 32 on the concave surface of the airfoil 12, thus minimizing the additional weight and cost of the film 32. While the concave surface of the airfoil 12 may be of particular interest, circumstances may exist where other surface areas of the blade 10 are of concern, such as the leading edge of the airfoil 12 or the region of the convex surface of the airfoil 12 near the leading edge.

In an investigation leading to the present invention, nickel-base superalloy specimens having a columnar 7% YSZ TBC deposited by EB-PVD on a PtAl diffusion bond coat were prepared. Some of these specimens were set aside as control samples. Aluminum metal was deposited by IPD to a thickness of about thirteen micrometers on other (experimental) specimens. The aluminum coatings were then oxidized by slowly heating the experimental specimens to a treatment temperature of about 870° C., and holding at the treatment temperature for about two hours. All specimens were then subjected to simulated CMAS contamination followed by one-hour cycles between room temperature and about 1230° C. until spallation of the TBC occurred. The average life for the experimental specimens was about three times that of the untreated control samples. SEM analysis of the experimental specimens confirmed that an aluminum-rich layer overlaid the TBC's and had infiltrated the larger columnar gaps of the TBC.

While the invention has been described in terms of a preferred embodiment, it is apparent that other forms could be adopted by one skilled in the art, such as by substituting other TBC, bond coat, and substrate materials, or by utilizing other or additional methods to deposit and process the protective deposit. Accordingly, the scope of the invention is to be limited only by the following claims.

What is claimed is:

1. A process for forming a film on a thermal barrier coating that inhibits infiltration of porosity within the thermal barrier coating by a contaminant having a melting point of up to about 1225° C. and containing oxides of calcium, magnesium, aluminum and silicon, the process comprising the steps of:

applying to an outermost surface of the thermal barrier coating a deposited composition containing at least one metal chosen from the group consisting of aluminum and magnesium, the deposited composition being applied so as to form a deposited film that lies on the outermost surface of the thermal barrier coating and overlies the porosity within the thermal barrier coating beneath the outermost surface thereof; and then converting the metal within the deposited film so that the deposited film forms an oxide film containing an oxide of the at least one metal that resists infiltration of the contaminant into the thermal barrier coating, at least a portion of the oxide film forming a surface deposit on the outermost surface of the thermal barrier coating and overlying the porosity within the thermal barrier coating to close the porosity at the outermost surface of the thermal barrier coating and thereby serve as a barrier to infiltration of the contaminant into the porosity within the thermal barrier coating.

2. A process according to claim 1, wherein the oxide of the at least one metal resists infiltration of the contaminant into the thermal barrier coating by reacting with the contaminant to form a refractory phase having a higher melting point than the contaminant.

3. A process according to claim 1, wherein the contaminant melts to form a molten contaminant having a viscosity, and the oxide of the at least one metal resists infiltration of the molten contaminant into the thermal barrier coating by reacting with the molten contaminant to form a refractory phase having a higher viscosity than the molten contaminant.

4. A process according to claim 1, wherein the deposited composition is chosen from the group consisting of commercially pure aluminum, aluminum-silicon alloys, and aluminum-magnesium alloys.

5. A process according to claim 1, wherein the deposited composition is applied so as to infiltrate the porosity within the thermal barrier coating, a second portion of the oxide film forming an internal deposit within the porosity of the thermal barrier coating.

6. A process according to claim 5, wherein infiltration of the porosity by the deposited composition is achieved by heating the thermal barrier coating during the applying step so as to melt the deposited composition during the applying step.

7. A process according to claim 5, wherein infiltration of the porosity by the deposited composition is achieved by heating the thermal barrier coating after the applying step so as to melt the deposited composition.

8. A process according to claim 1, wherein the deposited composition is converted to form the oxide film by heating the deposited composition in an oxidizing atmosphere.

9. A process according to claim 1, wherein the deposited composition is converted to form the oxide film by electrochemically reacting the deposited composition in an electrolytic treatment in which the deposited composition serves as an anode.

10. A process according to claim 1, wherein the deposited composition is applied to the outermost surface to have a thickness of about two to about fifteen micrometers.

11. A process according to claim 1, wherein the deposited composition is applied to the outermost surface to have a thickness of about fifteen to about fifty micrometers.

12. A process according to claim 1, wherein the deposited composition is applied to the outermost surface using an ion plasma deposition process.

13. A process according to claim 1, wherein the deposited composition is applied so that up to 50 volume percent of the deposited film is the oxide of the at least one metal.

14. A process according to claim 1, wherein the thermal barrier coating has a columnar grain structure and the porosity is defined by gaps between individual columns of the thermal barrier coating.

15. A process according to claim 1, wherein the thermal barrier coating has a noncolumnar grain structure.

16. A process for forming a film on a thermal barrier coating of yttria-stabilized zirconia that is present on a gas turbine engine component, the thermal barrier coating having a columnar grain structure and containing porosity defined by gaps between individual columns of the thermal barrier coating, the process comprising the steps of:

applying to an outermost surface of the thermal barrier coating a deposited composition containing at least one metal chosen from the group consisting of aluminum and magnesium, the deposited composition being applied so as to form on the outermost surface a deposited film containing not more than fifty volume percent of the oxide of the at least one metal;

heating the thermal barrier coating to cause the deposited composition to melt and infiltrate the porosity within the thermal barrier coating beneath the outermost surface; and then oxidizing the at least one metal of the deposited composition to form an oxide film that defines an external surface of the component and contains at least one oxide of the at least one metal, a first portion of the oxide film forming a surface deposit on the outermost surface of the thermal barrier coating and overlying the porosity within the thermal barrier coating to close the porosity at the outermost surface of the thermal barrier coating and thereby serve as a barrier to infiltration of the porosity within the thermal barrier coating, and a second portion of the oxide film forming an internal deposit within the porosity of the thermal barrier coating.

17. A process according to claim 16, wherein the deposited composition is chosen from the group consisting of commercially pure aluminum, aluminum-silicon alloys, and aluminum-magnesium alloys.

18. A process according to claim 16, wherein the deposited composition is converted to form the oxide film by heating the deposited composition in an oxidizing atmosphere.

19. A process according to claim 16, wherein the deposited composition is converted to form the oxide film by electrochemically reacting the deposited composition in an electrolytic treatment in which the deposited composition serves as an anode.

* * * * *